US009493945B2

(12) United States Patent
Bottin

(10) Patent No.: US 9,493,945 B2
(45) Date of Patent: Nov. 15, 2016

(54) WALL PANEL CONNECTING SYSTEM FOR MODULAR BUILDING UNITS

(71) Applicant: Herve Bottin, La Baule (FR)

(72) Inventor: Herve Bottin, La Baule (FR)

(73) Assignee: Williams Scotsman, Inc., Baltimore, MD (US)

( * ) Notice: Subject to any disclaimer, the term of this patent is extended or adjusted under 35 U.S.C. 154(b) by 0 days.

(21) Appl. No.: 14/802,011

(22) Filed: Jul. 17, 2015

(65) Prior Publication Data

US 2016/0017605 A1 Jan. 21, 2016

Related U.S. Application Data

(60) Provisional application No. 62/026,268, filed on Jul. 18, 2014.

(51) Int. Cl.

| | |
|---|---|
| ***E04C 2/00*** | (2006.01) |
| ***E04B 2/56*** | (2006.01) |
| ***E04B 2/00*** | (2006.01) |
| ***E04H 1/00*** | (2006.01) |
| ***E04B 1/348*** | (2006.01) |
| *E04B 1/61* | (2006.01) |
| *E04H 1/12* | (2006.01) |

(52) U.S. Cl.

CPC ..... *E04C 2/00* (2013.01); *E04B 1/3483* (2013.01); *E04B 2/56* (2013.01); *E04C 2/46* (2013.01); *E04H 1/005* (2013.01); *E04B 1/6112* (2013.01); *E04B 2001/6195* (2013.01); *E04C 2002/001* (2013.01); *E04H 2001/1283* (2013.01)

(58) Field of Classification Search

CPC ..... E04C 2/00; E04C 2/46; E04B 1/3483; E04B 2/56; E04B 1/6112; E04H 1/005

USPC ..... 52/279, 79.1, 79.5, 281, 282.3, 282.5

See application file for complete search history.

(56) References Cited

U.S. PATENT DOCUMENTS 2,667,242 A 1/1954 Kullmer
2,934,179 A * 4/1960 Larsen ..... E04B 1/6112 52/282.5

(Continued)

FOREIGN PATENT DOCUMENTS

DE 29718692 1/1998
DE 102009045934 4/2011

(Continued)

OTHER PUBLICATIONS

"Modular Construction." http://www.steelconstruction.info/Modular_construction Retrieved May 11, 2015.

*Primary Examiner* — Beth Stephan
(74) *Attorney, Agent, or Firm* — Whiteford, Taylor & Preston, LLP; Gregory M. Stone

(57) ABSTRACT

Disclosed is a connecting system for connecting wall panels to the support frame, and more particularly to the rigid corner support posts of a support frame, of a modular building unit. The connecting system includes a modular bracket assembly and is configured so that two modular connecting brackets attach to each corner vertical support column, which modular brackets are configured to receive the vertical edge of a wall panel. The brackets themselves are configured for easy replacement and/or adjustment through minimal effort, are fully symmetrical to allow use of bracket elements at varied locations, and may be replaced or adjusted particularly without removing, altering, or otherwise disturbing the corner vertical support column of the frame of the modular building unit.

12 Claims, 6 Drawing Sheets

(56) References Cited

U.S. PATENT DOCUMENTS

| | | | | | |
|---|---|---|---|---|---|
| 3,381,430 | A * | 5/1968 | Wiczer | E04B 1/6116 | 52/282.3 |
| 3,440,790 | A | 4/1969 | Nerem | | |
| 3,485,405 | A * | 12/1969 | Dement | B65D 9/32 | 217/65 |
| 3,738,083 | A | 6/1973 | Shimano | | |
| 3,751,865 | A | 8/1973 | Brigham | | |
| 4,034,535 | A * | 7/1977 | Dustmann | E04F 13/0892 | 52/280 |
| 4,065,885 | A | 1/1978 | Blick, III et al. | | |
| 4,189,885 | A | 2/1980 | Fritz | | |
| 4,192,113 | A | 3/1980 | Martin, Jr. | | |
| 4,196,553 | A | 4/1980 | Veach | | |
| 4,385,850 | A | 5/1983 | Bobath | | |
| 4,477,201 | A * | 10/1984 | Yoshiyuji | F16B 12/02 | 403/205 |
| 4,644,708 | A | 2/1987 | Baudot et al. | | |
| 4,689,930 | A | 9/1987 | Menchetti | | |
| 5,070,667 | A * | 12/1991 | Schulte | E04B 1/34321 | 52/241 |
| 5,404,684 | A * | 4/1995 | Schwendeman | A47B 47/0041 | 52/282.2 |
| 5,797,440 | A * | 8/1998 | Tsai | E04B 2/7425 | 160/135 |
| 6,052,958 | A | 4/2000 | Miedema et al. | | |
| 6,341,458 | B1 | 1/2002 | Burt | | |
| 6,694,694 | B2 | 2/2004 | Zeeff | | |
| 7,316,749 | B2 | 1/2008 | Smith | | |
| 7,727,446 | B1 | 6/2010 | Wolfe | | |
| 7,992,352 | B2 | 8/2011 | Bonds et al. | | |
| 8,011,849 | B2 | 9/2011 | Williams | | |
| 8,196,365 | B2 | 6/2012 | Parshad | | |
| 8,381,468 | B2 | 2/2013 | Koupal | | |
| 2002/0116890 | A1 | 8/2002 | Moore, Jr. | | |
| 2007/0227089 | A1 * | 10/2007 | Lewis | B64D 11/00 | 52/468 |
| 2008/0134589 | A1 * | 6/2008 | Abrams | E04B 1/003 | 52/79.1 |
| 2009/0139167 | A1 | 6/2009 | Donaldson et al. | | |

FOREIGN PATENT DOCUMENTS

| | | |
|---|---|---|
| FR | 2563858 | 11/1985 |
| WO | 2011029451 | 3/2011 |
| WO | 2014097197 | 6/2014 |

* cited by examiner

WALL PANEL CONNECTING SYSTEM FOR MODULAR BUILDING UNITS

CROSS REFERENCE TO RELATED APPLICATION

This application is based upon and claims benefit of U.S. Provisional Patent Application Ser. No. 62/026,268 entitled "CONNECTING KEY SYSTEM FOR MODULAR BUILDING UNITS," filed with the U.S. Patent and Trademark Office on Jul. 18, 2014 by the inventor herein, the specification of which is incorporated herein by reference in its entirety.

FIELD OF THE INVENTION

This invention relates generally to modular building construction, and more particularly to a connecting system for joining wall panels of a modular building unit to a corner column.

BACKGROUND OF THE INVENTION

Modular building units typically comprise a skeletal metal (e.g. steel) frame, a solid roof and floor, and wall panels that are inserted into the frame. The frame comprises an important structural element of the overall assembly, with the corner posts of the frame playing a primary support role for the remainder of the structure. In modular building configurations, it is desirable to maintain the corner posts as a principal support member to ensure proper support of the roof structure of the building unit, even if portions of the modular building unit other than the principal structural frame are to be replaced.

The wall panels of the modular building units are often attached by providing a U-shaped profile bracket along the long vertical edges (such as by connecting such U-shaped profile to the structural corner posts of the frame) to receive a wall panel having a rectangular cross section. However, such fixed U-shaped profile brackets provide a fixed dimension capable of receiving a wall panel of a single thickness. Different installations may require or desire walls of differing thicknesses, but allowing the replacement of one wall panel with another, differently configured wall panel can be difficult, requiring replacement of such U-shaped brackets and possibly other structural elements in order to accommodate such a change.

Thus, there remains a need in the art for a wall panel connecting system for a modular building unit capable of receiving panels of differing configurations, and more particularly for a wall panel connecting system that maintains the full skeletal support frame structure (including the corner support posts) of the modular building unit when reconfiguring the wall panel connections, and that allows reconfiguration of the wall panel connecting system without excessive effort or expense.

SUMMARY OF THE INVENTION

Disclosed is a connecting system for connecting wall panels to the support frame, and more particularly to the rigid corner support posts of a support frame, of a modular building unit. The connecting system includes a modular bracket assembly and is configured so that two modular connecting brackets attach to each corner vertical support column, which modular brackets are configured to receive the vertical edge of a wall panel. The brackets themselves are configured for easy replacement and/or adjustment through minimal effort, and particularly without removing, altering, or otherwise disturbing the corner vertical support column of the frame of the modular building unit.

In accordance with certain aspects of an embodiment of the invention, a wall panel connecting system is provided for a modular building unit, comprising: a modular building unit corner support post fixedly attached to a frame of said modular building unit, the corner support post having a first exterior face, a second exterior face, a first interior face, and a second interior face; a plurality of wall panels; and a modular wall panel connector configured for attachment to each of the first interior face and the second interior face of the corner support post, the modular wall panel connector further comprising an exterior portion detachably connectable to each of the first interior face and the second interior face of the corner support post and positioned to abut one of the wall panels at an exterior face of the wall panel, and an interior portion detachably connectable to the exterior portion and to each of the first interior face and the second interior face of the corner support post and positioned to abut the wall panel at an interior face of the wall panel.

In accordance with further aspects of an embodiment of the invention, a wall panel connecting system is provided for a modular building unit, comprising: a rigid, fixed modular building unit frame having a plurality of corner support posts, a bottom rail extending between adjacent pairs of corner support posts, a top rail extending between adjacent pairs of corner support posts, and a plurality of wall panels extending between the corner support posts, the top rails, and the bottom rails, each corner support post having a first exterior face, a second exterior face, a first interior face, and a second interior face; and a modular wall panel connector attached to each of the first interior face and the second interior face of each corner support post, the modular wall panel connector further comprising an exterior portion detachably connected to each of the first interior face and the second interior face of the corner support post and abutting one of the wall panels at an exterior face of the wall panel, and an interior portion detachably connected to each of the exterior portions and to each of the first interior face and the second interior face of the corner support post and abutting one of the wall panels at an interior face of that wall panel.

BRIEF DESCRIPTION OF THE DRAWINGS

The numerous advantages of the present invention may be better understood by those skilled in the art by reference to the accompanying drawings in which.

DETAILED DESCRIPTION OF THE PREFERRED EMBODIMENTS

The following description is of a particular embodiment of the invention, set out to enable one to practice an implementation of the invention, and is not intended to limit the preferred embodiment, but to serve as a particular example thereof. Those skilled in the art should appreciate that they may readily use the conception and specific embodiments disclosed as a basis for modifying or designing other methods and systems for carrying out the same purposes of the present invention. Those skilled in the art should also realize that such equivalent assemblies do not depart from the spirit and scope of the invention in its broadest form.

Figure 1:
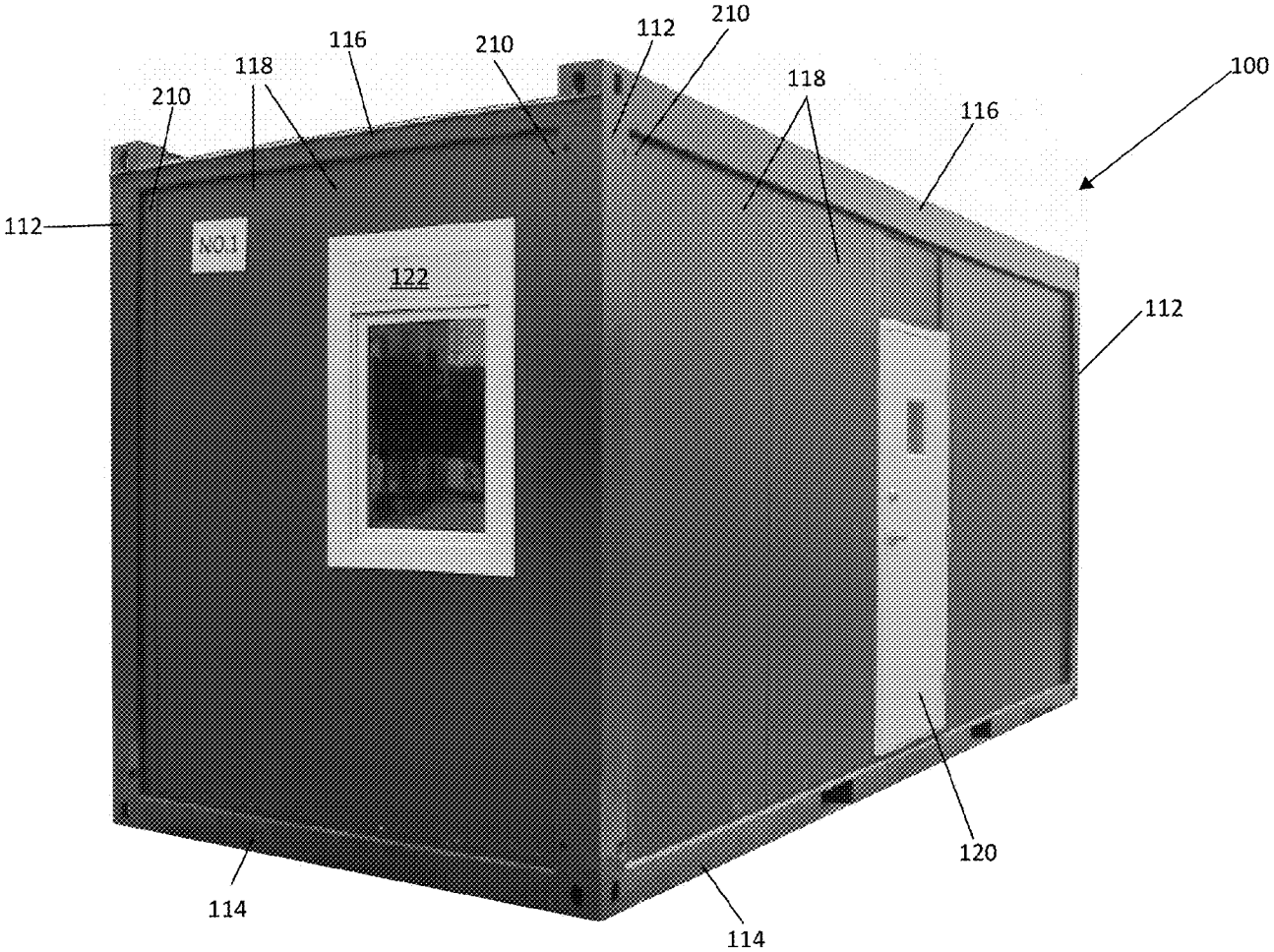
FIG. 1 is a perspective view of a modular building unit in accordance with certain aspects of an embodiment of the invention.

FIG. 1 provides a perspective view of a modular building unit 100 in accordance with certain aspects of an embodiment of the invention. Modular building unit 100 includes a skeletal frame formed by corner support posts 112, bottom rails 114, and top rails 116. This skeletal frame provides the key structural integrity for the modular building unit. Positioned between corner support posts 112, bottom rails 114, and top rails 116 are wall panels 118 that form the wall structures spanning each side of the modular building unit. Other standard building features, such as doors 120 and windows 122, may be provided and integrated with individual wall panels 118. Also visible in FIG. 1 is the exterior portion of a wall panel bracket 210 that mounts to corner support posts 112 and prevents wall panels 118 positioned adjacent to corner posts 112 from moving outward, and that covers any gap that might exist between wall panels 118 and their adjacent corner support posts 112, all as discussed in greater detail below.

Figure 2:
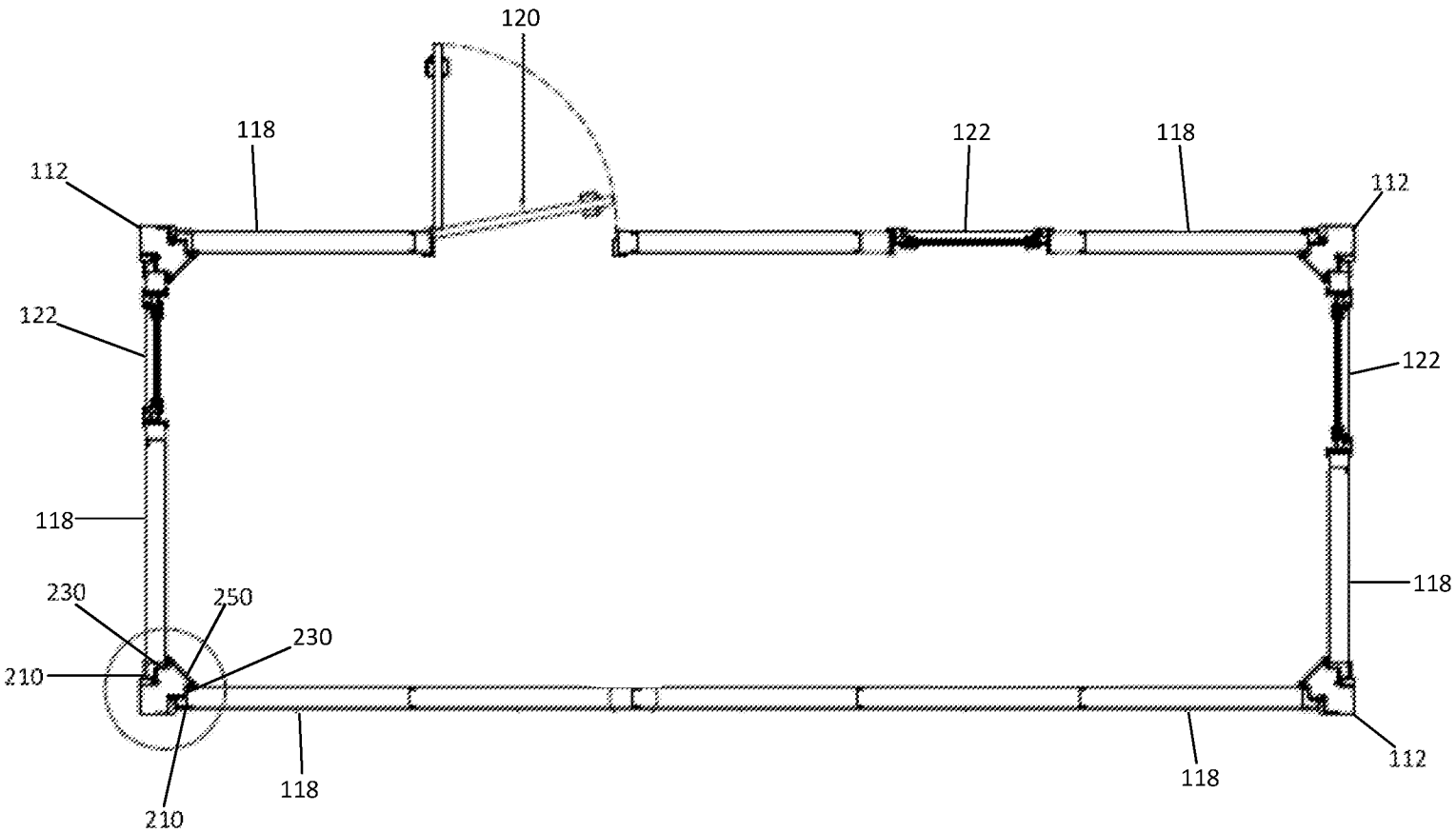
FIG. 2 is a top-down, sectional view of the modular building unit of FIG. 1.

FIG. 2 is a top down, sectional view of the modular building unit 100. As shown in FIG. 2, a modular wall panel bracket 200 is provided at each corner support post 112 to join wall panels 118 to the frame of the modular building unit. With continued reference to FIG. 2 and to the close-up, top down view of the modular wall panel bracket 200 and corner support post 112 of FIG. 3, each modular wall panel bracket 200 has an exterior portion 210, an interior portion 230, and preferably an interior corner trim piece 250. As discussed in greater detail below, exterior portion 210 establishes an exterior flange that blocks wall panel 118 from outward movement, and interior portion 230 establishes an interior flange that blocks wall panel 118 from interior movement, while corner trim piece 250 covers the points at which exterior portion 210 and interior portion 230 connect to corner support posts 112.

Figure 3:
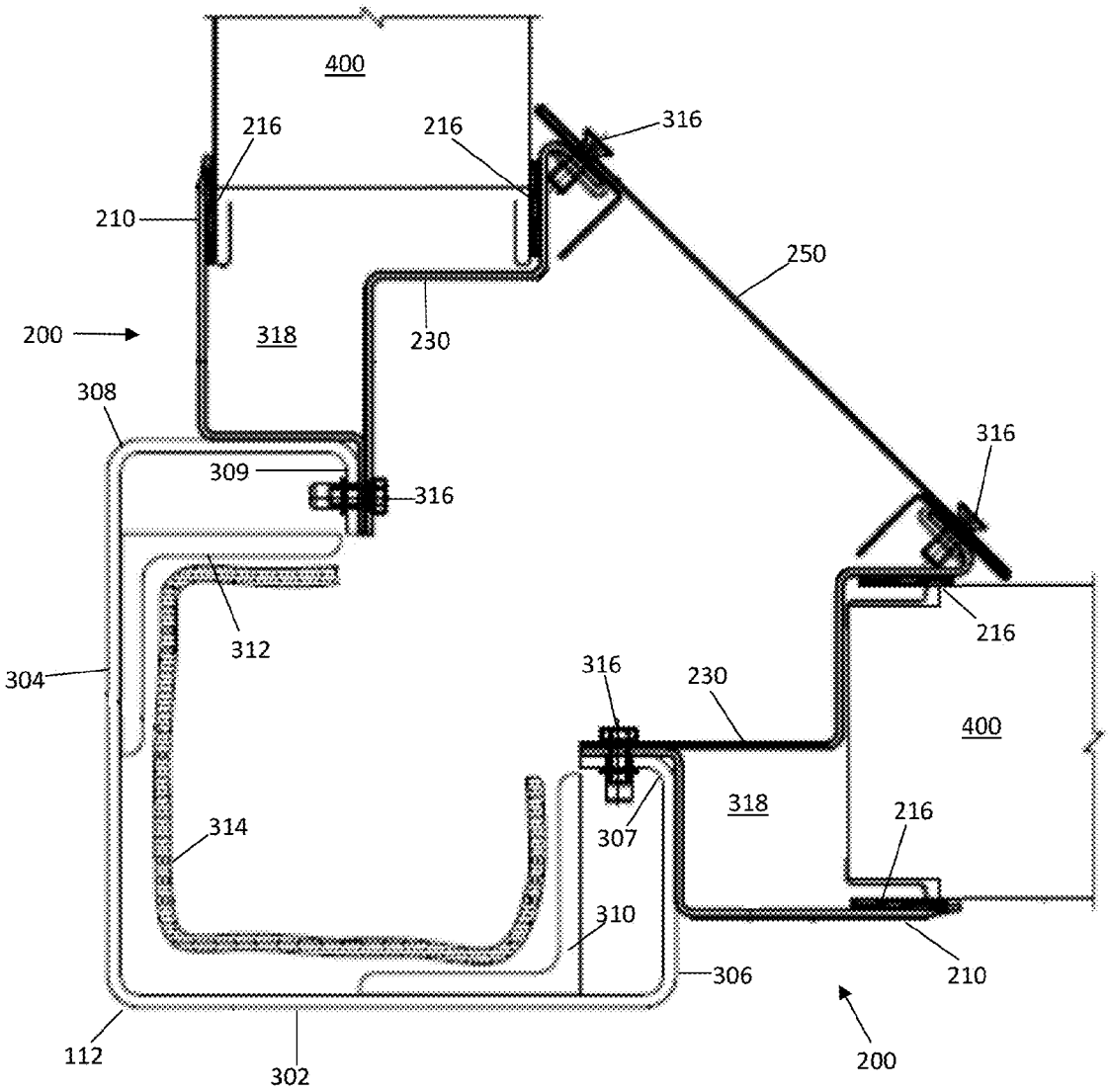
FIG. 3 is a close-up, top-down view of an exemplary modular wall panel bracket and corner support post for use with the modular building unit of FIG. 1.

With continued reference to FIG. 3, each corner support post 112 has a first outer wall 302 and a second outer wall 304, both of which form the exterior corner of the modular building unit 100. First outer wall 302 and second wall 304 may, for example, be configured at right angles to one another, although other angles, rounded corners, and the like may likewise by used as might be desirable to obtain a particular aesthetic or other benefit. A first interior wall 306 extends inward (toward the interior of modular building unit 100) from an end of exterior wall 302, and a second interior wall 308 extends inward from an end of exterior wall 304, thus forming a corner support post having at least four distinct sides. Interior walls 306 and 308 each have a length less than the lengths of the respective outer walls 302 and 304 to which they are attached in order to properly allow for connection of the modular wall panel bracket 200, as discussed in greater detail below.

A first connecting flange 307 extends from an end of first interior wall 306 toward an interior of support post 112, and a second connecting flange 309 extends from an end of second interior wall 308 toward the interior of support post 112, such that first connecting flange 307 is positioned generally perpendicular to second connecting flange 309. Optionally, a first support rib 310 may be positioned on an interior face of first outer wall 302, and a second support rib 312 may be positioned on an interior face of second outer wall 304, each such support rib forming a right angle vertical member extending through corner support post 112. An insulation sheet 314 may also optionally be provided on an interior of support post 112, positioned to sit within opposing support ribs 310 and 312 on the interior of support post 112.

Modular wall panel brackets 200 join to support post 112 at first connecting flange 307 and second connecting flange 309. More particularly, and as shown in FIG. 3, exterior portion 210 of wall panel bracket 200 and interior portion 230 of wall panel bracket 200 are each connected to each of first connecting flange 307 and second connecting flange 309 with a removable, threaded connector 316, such as a screw, a bolt and nut assembly, or such other removable connector as will be known to those of ordinary skill in the art. While a first end of each of exterior portion 210 of wall panel bracket 200 and interior portion 230 of wall panel bracket 200 are brought together for connection to the respective connecting flange 307 or 309 of support post 112, the opposite end of each of exterior portion 210 of wall panel bracket 200 and interior portion 230 of wall panel bracket 200 form a gap configured to receive the end of a wall panel 400, such that the end of the wall panel 400 extends into the open space between the ends of exterior portion 210 and interior portion 230 of wall panel bracket 200. Compressible foam gaskets 216 may be provided on the interior face of each of exterior portion 210 and interior portion 230 of wall panel bracket 200 and positioned to sit between each of exterior portion 210 and interior portion 230 of wall panel bracket 200 and the wall panel 400 positioned between them, thus providing a compressible seal against air and water infiltration into modular building unit 100.

In the configuration shown in FIG. 3, wall panel 400 is positioned a distance away from support post 112, creating a gap 318 between wall panel 400 and support post 112 (surrounded on its sides by exterior portion 210 and interior portion 230 of wall panel bracket 200). Optionally, insulation may be fitted within gap 318 to further aid in preventing air infiltration into and out from modular building unit 100.

Figure 4:
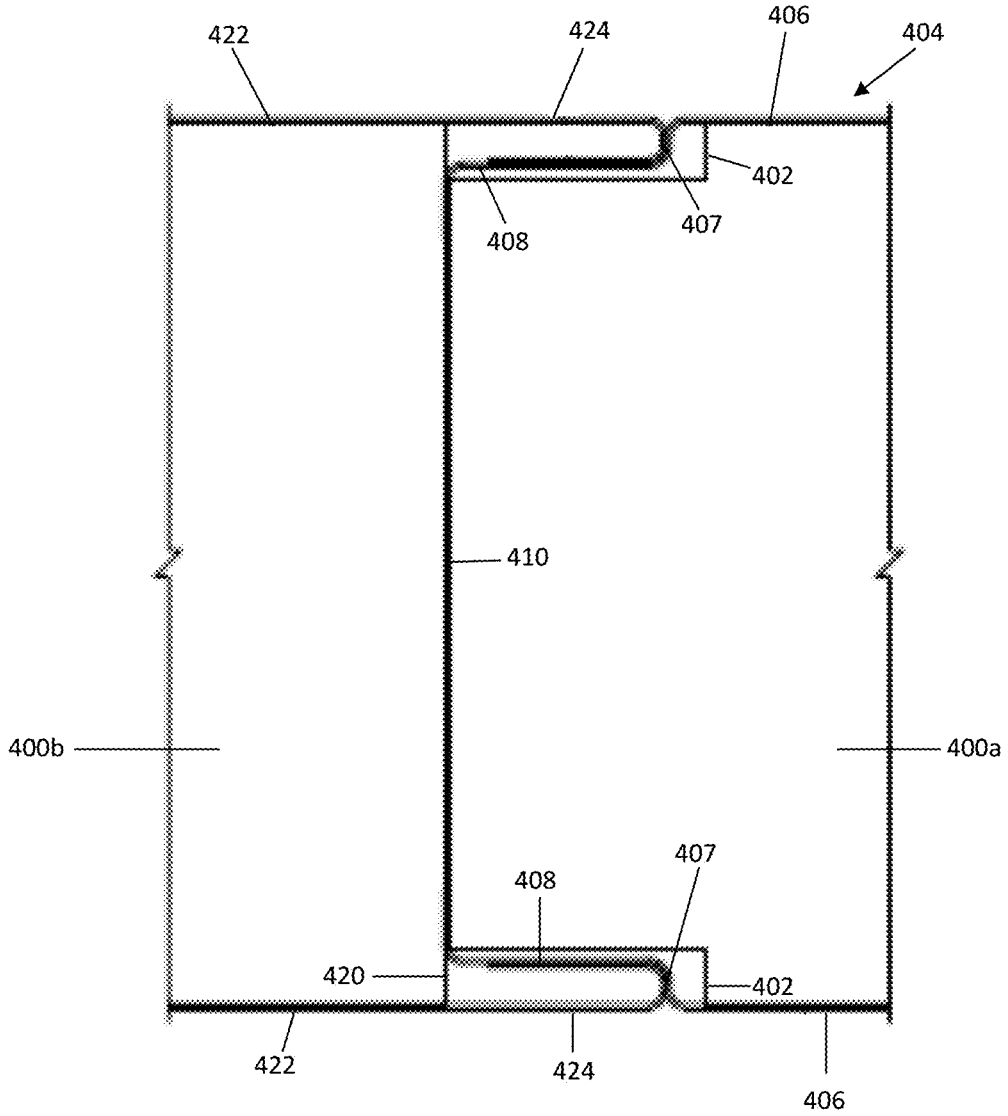
FIG. 4 is a close-up, top-down view of joined wall panels of FIG. 2.

FIG. 4 provides a close-up, top down view of joined wall panels 400 for use with the connecting system described herein. Each wall panel has a male connector edge **400*a* and a female connector edge 400*b* opposite male connector edge 400*a*. Male connector edge 400*a* has an inwardly stepped section 402 so as to form a narrowed head along male connector edge 400*a*. A connecting bracket 404 is provided along the exterior of male connecter edge 400*a*, and has an outer most portion 406 that defines the maximum width of wall panel 400, an inwardly turned step 407, a connecting edge 408 extending from step 407 to the end of male connector edge 400*a*, and a facing edge 410 extending between connecting edges 408 on either side of wall panel 400. Facing edge 410 of male connector edge 400*a* abuts facing edge 420 of female connector edge 400*b* of an adjacent panel 400**, as discussed below.

With continued reference to FIG. 4, female connector edge 400*b* includes a bracket 422 along the exterior of female connector edge 400*b*, matching in width the outer most portion 406 of bracket 404 on male connector edge 400*a*. Each bracket 422 forms a tongue engaging surface 424 sized to fit within step 407 of bracket 404 on male connector edge 400*a*, thus enabling the joining of two adjacent wall panels in a tongue and groove connection allowing movement, separation, and replacement of wall panels on modular building unit 100 if and as desired.

Figure 6:
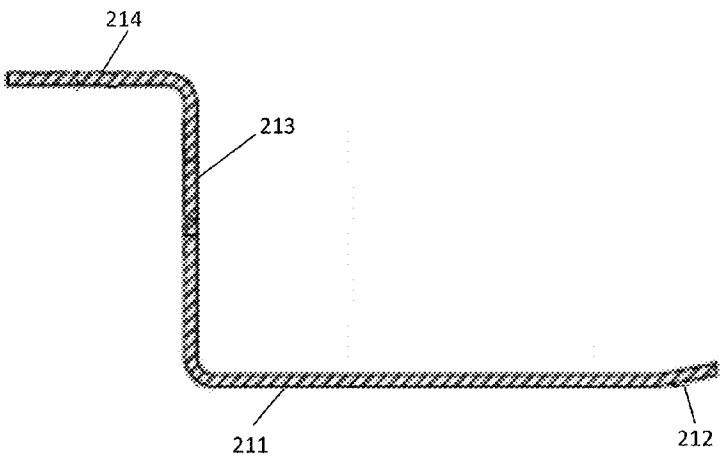
FIG. 6 is a top-down, cross-sectional view of the exterior portion of the modular wall panel bracket of FIG. 5.
Figure 5:
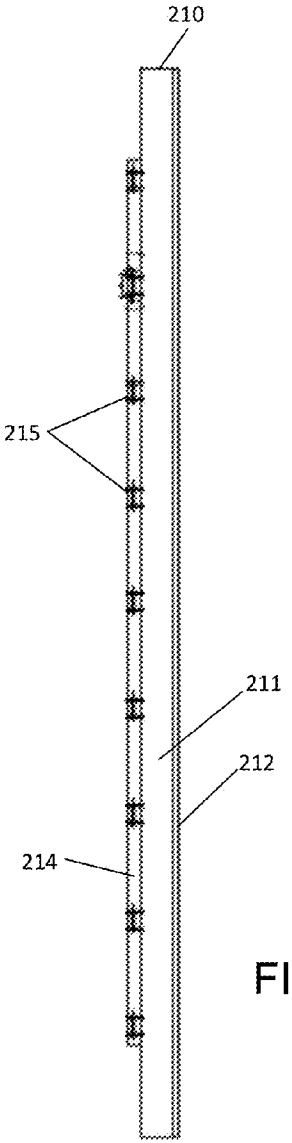
FIG. 5 is a front view of an exterior portion of a modular wall panel bracket of FIG. 2.

FIG. 5 provides a detail front view of exterior portion 210 of modular wall panel bracket 200, and FIG. 6 provides a top-down, cross-sectional view of such exterior portion 210. As mentioned briefly above, exterior portion 210 of modular wall panel bracket 200 has an outer face 211 which forms an exterior surface of modular building unit 100 positioned between each corner support post 112 and an adjacent wall panel 400, preventing movement of the wall panel toward the exterior of modular building unit 100. A distal end of outer face 211 has a slightly inwardly bending flange 212, thus preventing space between the interior of outer face 211 and the face of the wall panel 400 against which outer face 211 sits to accommodate a compressible gasket 216. An interior column-facing arm 213 extends generally at a right angle from outer face 211, which interior column-facing arm 213 is configured to abut first interior wall 306 of corner support post 112. Interior column-facing arm 213 is preferably of smaller width than first interior wall 306 of corner support post 112, so that outer face 211 of exterior portion 210 (and thus the wall panel 400 that exterior portion 210 restrains) sits slightly recessed from the outer walls 302 and 304 to corner support posts 112, and from the outer faces of bottom rails 114 and top rails 116 of modular building unit 100. A connecting arm 214 extends at generally a right angle from interior column-facing arm 213, which connecting arm 214 is configured to abut connecting flanges 307 and 309 of corner support post 112. A plurality of openings 215 are provided along the length of connecting arm 214 through which fasteners may be placed to join exterior portion 210 of modular wall bracket 200 to corner support post 112. Such openings 215 may optionally be formed as elongate slots to allow vertical adjustment of exterior portion 210 of modular wall bracket 200 as may be necessary or desirable for varied installation environments. The particular position and configuration of openings 215 are symmetrical along connecting arm 214 so as to avoid requiring identification of right or left edges or top and bottom portions during installation, thus allowing exterior portion 210 of modular wall panel bracket 200 to be attached at either side of corner support posts 112.

As shown in FIG. 5, connecting arm 214 need not extend the full length of interior column-facing arm 213, thus providing open space at the top and bottom of connecting flanges 307 and 309 on corner support posts 112, which may be desirable to maintain access to the interior of corner supports posts 112 or other portions or components of modular building unit 100.

Figure 8:
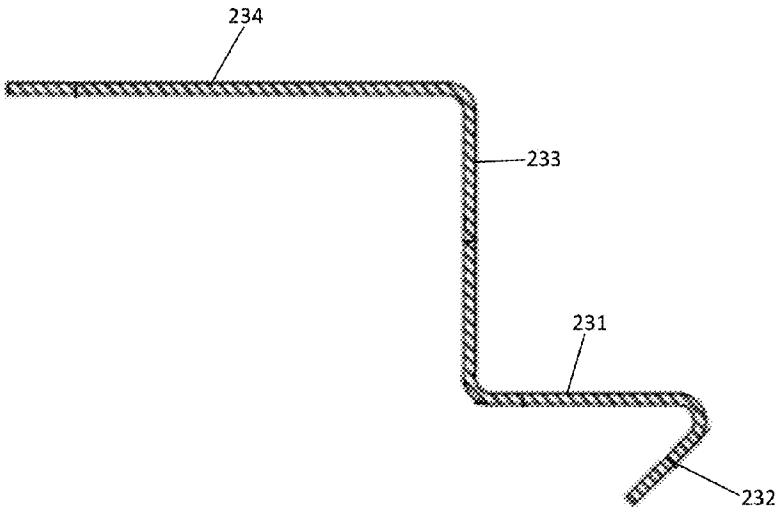
FIG. 8 is a top-down, cross-sectional view of the interior portion of the modular wall panel bracket of FIG. 7.
Figure 7:
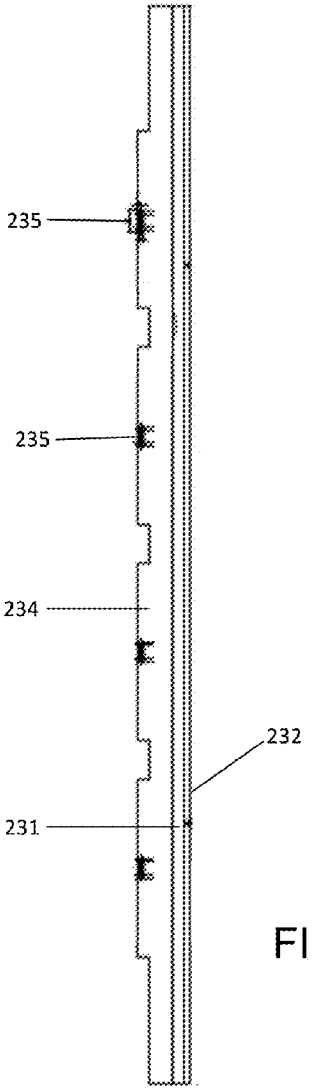
FIG. 7 is a front view of an interior portion of a modular wall panel bracket of FIG. 2.

Likewise, FIG. 7 provides a detail front view of interior portion 230 of modular wall panel bracket 200, and FIG. 8 provides a top-down, cross-sectional view of such interior portion 230. As mentioned briefly above, interior portion 230 of modular wall panel bracket 200 has an interior face 231 which forms an interior surface of modular building unit 100 positioned between each corner support post 112 and an adjacent wall panel 400, preventing movement of the wall panel toward the interior of modular building unit 100. A distal end of interior face 231 may be provided a connection hook 232 that is positioned to receive interior corner trim 250, as discussed further below. An interior wall stop arm 233 extends generally at a right angle from interior face 231, which interior wall stop arm 213 is configured to abut the end of a wall panel 400. Wall stop arm 233 is positioned with respect to interior walls 306 and 308 of corner support posts 112 to create gaps 318, which as mentioned above may be used to position insulation within the corner joints of modular building unit 100. A connecting arm 234 extends at generally a right angle from interior wall stop arm 233, which connecting arm 234 is configured to abut interior column-facing arms 213 on exterior portion 210 of bracket 200 and in alignment with connecting flanges 307 and 309 of corner support post 112. A plurality of openings 235 are provided along the length of connecting arm 234 through which fasteners may be placed to join interior portion 230 of modular wall bracket 200 to corner support post 112. Such openings 235 may optionally be formed as elongate slots to allow vertical adjustment of interior portion 230 of modular wall bracket 200 as may be necessary or desirable for varied installation environments. Likewise, as noted above with respect to FIG. 5, the particular position and configuration of openings 235 are symmetrical along connecting arm 234 so as to avoid requiring identification of right or left edges or top and bottom portions during installation, thus allowing interior portion 230 of modular wall panel bracket 200 to be attached at either side of corner support posts 112.

As shown in FIG. 7, connecting arm 234 need not extend the full length of interior wall stop arm 233, thus providing open space at the top and bottom of connecting flanges 307 and 309 on corner support posts 112, which may be desirable to maintain access to the interior of corner supports posts 112 or other portions or components of modular building unit 100.

As mentioned above, connection hook 232 may be provided at the distal end of interior face 231 of interior portion 230. With reference again to FIG. 3, connection hook 232 may have preferably two or more openings to receive threaded connectors 316, which threaded connectors may be used to attached outer edges of an elongate corner trim piece 250 to interior portion 230 of wall panel bracket 200, thus providing a clean and finished appearance to the interior corner joints of modular building unit 100. Elongate corner piece 250 may likewise be joined to interior portion 230 with hook-and-loop fastening material, non-permanent adhesive, or such other non-permanent attachment mechanisms as may occur to those of ordinary skill in the art.

With this assembly, those skilled in the art will recognize that modification of wall panels is easily managed, including replacing wall panels of a certain thickness with wall panels of a differing thickness, as may be desirable to, for example, reduce material costs in environments with lower environmental stress concerns. Specifically, by simply removing corner trim piece 250 and changing only the interior portion 230 of modular bracket 200 (i.e., changing the length of interior wall stop arm 233), wall panels 400 of varying thicknesses may be easily and quickly accommodated. While interior portion 230 of wall panel bracket 200 may be provided with different dimensions of wall stop arm 233, interior wall stop arm 233 may alternatively be adjustable (in any of multiple manners as will be apparent to those skilled in the art) to allow a single set of components to be used with modular building unit configurations having varied wall thicknesses.

Also, those of ordinary skill in the art will recognize that the components described herein may be modified from the specific examples presented without departing from the spirit and scope of the invention. For instance, the elements of modular wall bracket 200 may be comprised steel, but may likewise be comprised of, for example, PVC or other materials, for example to improve thermal insulation.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It should be understood, therefore, that the invention may be practiced otherwise than as specifically set forth herein.

The invention claimed is:

1. A wall panel connecting system for a modular building unit, comprising:

a modular building unit corner support post fixedly attached to a frame of said modular building unit, said corner support post having a first exterior face, a second exterior face, a first interior face, and a second interior face;

a plurality of wall panels; and a first modular wall panel connector configured for attachment to said first interior face of said corner support post, and a second modular wall panel connector configured for attachment to said second interior face of said corner support post, each said modular wall panel connector further comprising a pair of brackets, and each of said pair of brackets further comprising:

an exterior portion having a first distal end and a second distal end, the first distal end detachably connectable to one of said first interior face and said second interior face of said corner support post and said second distal end positioned to abut one of said wall panels at an exterior face of said wall panel; and an interior portion having a first distal end and a second distal end, the first distal end of the interior portion detachably connectable to said exterior portion and to one of said first interior face and said second interior face of said corner support post and said second distal end of said interior portion positioned to abut said wall panel at an interior face of said wall panel, said corner support post further comprising a first connecting flange extending from said first interior face toward an interior of said corner support post, and a second connecting flange extending from said second interior face toward said interior of said corner support post;

each said exterior portion of said brackets further comprising the first distal end thereof having an exterior connecting arm configured for positioning against and removable attachment to one of said first and second connecting flanges of said corner support post; and each said interior portion of said brackets further comprising the first distal end thereof having an interior connecting arm configured for positioning against said exterior connecting arm of said exterior portion of said modular wall panel connector, and for removable attachment to one of said first and second connecting flanges of said corner support post.

2. The wall panel connecting system of claim 1, each said exterior portion having the second distal end thereof opposite said exterior connecting arm, and each said interior portion having the second distal end thereof opposite said interior connecting arm, wherein each said exterior portion and each said interior portion are further configured to provide a wall panel receiving opening between said second distal ends of said exterior portion and said interior portion when said interior connecting arm is attached to said exterior connecting arm.

3. The wall panel connecting system of claim 2, each said interior portion further comprising an interior wall stop arm extending at a right angle from said interior connecting arm and forming a stop to block movement of one of said wall panels toward said corner support post.

4. The wall panel connecting system of claim 1, each said interior portion further comprising a connection hook at an end of said interior portion opposite said interior connecting arm and positioned to mount a corner trim piece adjacent said corner support post.

5. The wall panel connecting system of claim 4, further comprising a corner trim member detachably connectable to said connection hook.

6. The wall panel connecting system of claim 1, further comprising a gasket positioned on an interior face of said exterior portion of said modular wall panel connector and a gasket positioned on an exterior face of said interior portion of modular wall panel connector.

7. A wall panel connecting system for a modular building unit, comprising:

a rigid, fixed modular building unit frame having a plurality of corner support posts, a plurality of bottom rails extending between adjacent pairs of the corner support posts, a plurality of top rails extending between the adjacent pairs of corner support posts, and a plurality of wall panels extending between said corner support posts, said top rails, and said bottom rails, each said corner support post having a first exterior face, a second exterior face, a first interior face, and a second interior face; and a first modular wall panel connector attached to said first interior face of said corner support post, and a second modular wall panel connector configured for attachment to said second interior face of each said corner support post, each said modular wall panel connector further comprising a pair of brackets, and each of said pair of brackets further comprising:

an exterior portion having a first distal end and a second distal end, the first distal end detachably connected to one of said first interior face and said second interior face of said corner support post and said second distal end abutting one of said wall panels at an exterior face of said wall panel; and an interior portion having a first distal end and a second distal end, the first distal end thereof detachably connected to one of said exterior portions and to one of said first interior face and said second interior face of said corner support post and said second distal end thereof abutting said one of said wall panels at an interior face of said one of said wall panels;

each said corner support post further comprising a first connecting flange extending from said first interior face toward an interior of said corner support post, and a second connecting flange extending from said second interior face toward said interior of said corner support post;

each said exterior portion of said brackets further comprising the first distal end thereof having an exterior connecting arm positioned against and removably attached to one of said first and second connecting flanges on said corner support post; and each said interior portion of said brackets further comprising the first distal end thereof having an interior connecting arm positioned against said exterior connecting arm of said exterior portion of said modular wall panel connector, and removably attached to one of said first and second connecting flanges on said corner support post.

8. The wall panel connecting system of claim 7, each said exterior portion having the second distal end thereof opposite said exterior connecting arm, and each said interior portion having the second distal end thereof opposite said interior connecting arm, each said exterior portion and each said interior portion forming a wall panel receiving opening between said second distal ends of said exterior portion and said interior portion holding an edge of a wall panel.

9. The wall panel connecting system of claim 8, each said interior portion further comprising an interior wall stop arm extending at a right angle from said interior connecting arm and forming a stop blocking movement of an adjacent wall panel toward said corner support post.

10. The wall panel connecting system of claim 7, each said interior portion further comprising a connection hook at an end of said interior portion opposite said interior connecting arm.

11. The wall panel connecting system of claim 10, further comprising a corner trim member detachably connectable to each said connection hook.

12. The wall panel connecting system of claim 7, further comprising a gasket positioned on an interior face of each said exterior portion of said modular wall panel connector and a gasket positioned on an exterior face of each said interior portion of modular wall panel connector such that each said gasket abuts a face of an adjacent wall panel.

* * * * *